US008926767B2

(12) United States Patent
Teramoto et al.

(10) Patent No.: US 8,926,767 B2
(45) **Date of Patent: *Jan. 6, 2015**

(54) STEEL PART FOR MACHINE STRUCTURAL USE AND MANUFACTURING METHOD THEREOF

(75) Inventors: Shinya Teramoto, Tokyo (JP); Hiromasa Takada, Tokyo (JP); Manabu Kubota, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/823,655

(22) PCT Filed: May 25, 2012

(86) PCT No.: PCT/JP2012/063518

§ 371 (c)(1), (2), (4) Date: Mar. 14, 2013

(87) PCT Pub. No.: WO2012/161323

PCT Pub. Date: Nov. 29, 2012

(65) Prior Publication Data

US 2013/0167986 A1 Jul. 4, 2013

(30) Foreign Application Priority Data

May 26, 2011 (JP) ..... 2011-118351

(51) Int. Cl.

| | |
|---|---|
| ***C21D 8/00*** | (2006.01) |
| ***C22C 38/00*** | (2006.01) |
| ***B21J 1/00*** | (2006.01) |
| ***C21D 1/20*** | (2006.01) |

(52) U.S. Cl.

CPC ..... *C21D 8/005* (2013.01); *C21D 2211/004* (2013.01); *C21D 2211/002* (2013.01); *B21J 1/003* (2013.01); *C21D 1/20* (2013.01)

USPC ..... 148/328; 148/624

(58) Field of Classification Search

USPC ..... 148/624, 328

See application file for complete search history.

(56) References Cited

U.S. PATENT DOCUMENTS

| | | | |
|---|---|---|---|
| 4,936,926 | A | 6/1990 | Matsumoto et al. |
| 5,362,338 | A | 11/1994 | Iwama et al. |

FOREIGN PATENT DOCUMENTS

| | | | | |
|---|---|---|---|---|
| EP | 0 648 853 | A1 | | 4/1995 |
| JP | 1-116032 | A | | 5/1989 |
| JP | 1-198450 | A | | 8/1989 |
| JP | 03260010 | A | * | 11/1991 |
| JP | 4-176842 | A | | 6/1992 |
| JP | 6-88162 | A | | 3/1994 |
| JP | 6-306460 | A | | 11/1994 |
| JP | 7-3385 | A | | 1/1995 |
| JP | 3300511 | B2 | | 7/2002 |
| JP | 2003-147479 | A | | 5/2003 |
| JP | 2004-169055 | A | | 6/2004 |
| JP | 2004169055 | A | * | 6/2004 |
| JP | 2006-037177 | A | | 2/2006 |
| JP | 2009-84648 | A | | 4/2009 |
| JP | 2010163671 | A | * | 7/2010 |
| JP | 2010-242170 | A | | 10/2010 |
| JP | 2011-241441 | A | | 12/2011 |

OTHER PUBLICATIONS

Chinese Office Action dated Dec. 18, 2013 for Chinese Application No. 201280003607.4.

International Search Report, issued in PCT/JP2012/063518, dated Jul. 24, 2012.

Takada et al., "Micro-structure and mechanical properties of microalloyed bainite forging steel", Current advances in materials and processes, vol. 5, No. 6, Sep. 1992, p. 1902.

* cited by examiner

*Primary Examiner* — Roy King

*Assistant Examiner* — Jenny Wu

(74) *Attorney, Agent, or Firm* — Birch, Stewart, Kolasch & Birch, LLP

(57) ABSTRACT

The present invention provides a steel part for machine structural use whose fatigue strength and toughness are improved and a manufacturing method thereof. A steel part made of a steel containing, in mass %, C: 0.05 to 0.20%, Si: 0.10 to 1.00%, Mn: 0.75 to 3.00%, P: 0.001 to 0.050%, S: 0.001 to 0.200%, V: exceeding 0.25 to 0.50%, Cr: 0.01 to 1.00%, Al: 0.001 to 0.500%, and N: 0.0080 to 0.0200%, and a balance being composed of Fe and inevitable impurities, in which a steel structure contains a bainite structure having an area ratio of 95% or more, a bainite lath width is 5 μm or less, V carbide having an average grain diameter of not less than 4 nm nor more than 7 nm dispersedly exists in the bainite structure, and an area ratio of V carbide in the bainite structure is 0.18% or more.

3 Claims, No Drawings

STEEL PART FOR MACHINE STRUCTURAL USE AND MANUFACTURING METHOD THEREOF

TECHNICAL FIELD

The present invention relates to a steel part for machine structural use of a transportation machine such as an automobile, an industrial machine, and the like and a manufacturing method thereof, and particularly relates to a steel part for machine structural use having high fatigue strength and high toughness without its machinability being deteriorated and a manufacturing method thereof. This application is based upon and claims the benefit of priority of the prior Japanese Patent Application No. 2011-118351, filed on May 26, 2011, the entire contents of which are incorporated herein by reference.

BACKGROUND ART

Conventionally, in many cases, high strength and high toughness have been given to a machine structure part for an automobile, an industrial machine, and the like in a manner that a steel product such as a bar steel is hot forged into a part shape and then is reheated to be subjected to thermal refining of quenching and tempering. In recent years, in terms of a reduction in manufacturing cost, an omission of a thermal refining process of quenching and tempering has been promoted, and as shown in Patent Document 1 and the like, for example, there has been proposed a non-heat-treated steel to which high strength and high toughness can be given even though it remains being hot-forged. However, that both high fatigue strength and excellent machinability are accomplished is actually to be an obstacle to the application of the high strength and high toughness non-heat-treated steel to a steel part for machine structural use.

Generally, the fatigue strength relies on tensile strength, and as the tensile strength is increased, the fatigue strength is increased. On the other hand, the increase in tensile strength deteriorates the machinability. Many of the steel parts for machine structural use need to be cut after being hot forged, and the cutting cost accounts for most of the manufacturing cost of the part. The deterioration of machinability caused by the increase in tensile strength causes the significant increase in manufacturing cost of the part. Generally, when the tensile strength exceeds 1200 MPa, the machinability deteriorates significantly and the manufacturing cost is increased drastically, and thus it is practically difficult to achieve the high strength in excess of the above strength. Thus, in the parts for machine structural use, the increase in cutting cost caused by the deterioration of machinability is a bottleneck in achieving the high fatigue strength, and a technique of accomplishing both the high fatigue strength and the excellent machinability is required.

As conventional knowledge of securing machinability even though the steel part is high in strength, in Patent Document 2, for example, it has been proposed that a large amount of V is added to a steel, V carbonitride that has precipitated by an aging treatment is attached to a tool surface at the time of machining to protect the tool, which is effective for preventing tool abrasion. However, a large amount of V is needed in order to secure the machinability, and due to the steel being a high alloy, hot ductility is significantly poor. In the case when such a steel is used, there is caused a problem of occurrence of cracking and flaws to occur at the time of casting and flaws at the time of subsequent hot working, namely at the time of hot rolling of a bar steel and hot forging of a part.

As a means of accomplishing both the high fatigue strength and the excellent machinability, it is effective to improve the ratio of the fatigue strength to the tensile strength, namely an endurance ratio (the fatigue strength/the tensile strength). In Patent Document 3, for example, it has been proposed that it is effective to turn a structure mainly composed of bainite to decrease high-carbon martensite island and retained austenite in the structure. However, the endurance ratio is 0.56 or less at the most, there is a limit to increase the strength without deteriorating the machinability, and the fatigue strength and the tensile strength are both low.

Further, in Patent Document 4, for example, it has been proposed that it is effective to turn a structure into a fine ferrite-bainite structure after molding by warm forging in a temperature zone of 800 to 1050° C. and to cause V carbonitride to precipitate by a subsequent aging treatment. Generally, there is shown a tendency for the toughness to decrease when the achievement of high endurance ratio is accomplished, but by the warm forging, the ferrite-bainite structure is made fine, and thereby the toughness is improved. However, in the steel part for machine structural use requiring toughness, the improvement of toughness is small. Further, in the warm forging in the temperature zone of 800 to 1050° C., a forging load is large to thereby decrease the life of a mold significantly, and thus the production is difficult to be performed industrially.

Further, in Patent Documents 5 and 6, for example, there has been proposed a method of increasing strength by causing Ti carbide and V carbide to precipitate in a steel. However, when Ti is contained, Ti turns into nitride at high temperature preferentially to carbide, and thereby coarse Ti nitride is formed, and Ti nitride does not contribute to precipitation strengthening and further significantly decreases an impact value.

PRIOR ART DOCUMENT

Patent Document

[Patent Document 1] Japanese Laid-open Patent Publication No. H1-198450
[Patent Document 2] Japanese Laid-open Patent Publication No. 2004-169055
[Patent Document 3] Japanese Laid-open Patent Publication No. H4-176842
[Patent Document 4] Japanese Patent No. 3300511
[Patent Document 5] Japanese Laid-open Patent Publication No. 2011-241441
[Patent Document 6] Japanese Laid-open Patent Publication No. 2009-84648

DISCLOSURE OF THE INVENTION

Problems to Be Solved by the Invention

The present invention has an object to provide a steel part for machine structural use whose fatigue strength and toughness are improved without its machinability being deteriorated by controlling a structure in the part in subsequent cooling and a heat treatment even with ordinary hot forging, and a manufacturing method thereof.

Means for Solving the Problems

In the present invention, it was found to obtain a steel part for machine structural use having high Charpy absorbed energy and a high endurance ratio and having its fatigue strength and toughness improved without its machinability being deteriorated in a manner that, after hot forging, by cooling a hot-forged steel product at a relatively fast cooling rate, the main structure is caused to turn into fine bainite, and then V carbide is caused to precipitate in the bainite structure by an aging treatment to control the size and dispersed state of V carbide, and the present invention was completed.

The gist of the present invention is as follows.

(1) A steel part for machine structural use made of a steel containing,
in mass %,
C: 0.05 to 0.20%,
Si: 0.10 to 1.00%,
Mn: 0.75 to 3.00%,
P: 0.001 to 0.050%,
S: 0.001 to 0.200%,
V: exceeding 0.25 to 0.50%,
Cr: 0.01 to 1.00%,
Al: 0.001 to 0.500%, and
N: 0.0080 to 0.0200%, and
a balance being composed of Fe and inevitable impurities, in which a steel structure contains a bainite structure having an area ratio of 95% or more,
a bainite lath width is 5 μm or less,
V carbide having an average grain diameter of not less than 4 nm nor more than 7 nm dispersedly exists in the bainite structure, and an area ratio of V carbide in the bainite structure is 0.18% or more.

(2) The steel part for machine structural use according to (1), in which the steel further contains one type or two types or more of, in mass %,
Ca: 0.0003 to 0.0100%,
Mg: 0.0003 to 0.0100%, and
Zr: 0.0005 to 0.1000%.

(3) The steel part for machine structural use according to (1) or (2), in which the steel further contains one type or two types of, in mass %,
Mo: 0.01 to 1.00%, and
Nb: 0.001 to 0.200%.

(4) The steel part for machine structural use according to (1), in which Charpy absorbed energy at 20° C. is 80 J/cm$^2$ or more and an endurance ratio is 0.60 or more.

(5) A manufacturing method of a steel part for machine structural use includes:
heating a steel product containing, in mass %,
C: 0.05 to 0.20%,
Si: 0.10 to 1.00%,
Mn: 0.75 to 3.00%,
P: 0.001 to 0.050%,
S: 0.001 to 0.200%,
V: exceeding 0.25 to 0.50%,
Cr: 0.01 to 1.00%,
Al: 0.001 to 0.500%, and
N: 0.0080 to 0.0200%, and
a balance being composed of Fe and inevitable impurities to not lower than 1100° C. nor higher than 1300° C. and hot forging the steel product;
after the hot forging, cooling the hot-forged steel product at an average cooling rate down to 300° C. set to be not less than 3° C./second nor more than 120° C./second; and
after the cooling, performing an aging treatment within a temperature range of not lower than 550° C. nor higher than 700° C.

Effect of the Invention

According to the present invention, it becomes possible to provide a steel part for machine structural use having high fatigue strength and high toughness without increasing cutting cost by selecting a steel component range, a structure form, and a heat treatment condition, which is extremely effective industrially.

MODE FOR CARRYING OUT THE INVENTION

The present inventors earnestly examined a steel component range, a structure form, and a heat treatment condition with respect to the above-described object, and consequently obtained the following pieces of knowledge (a) to (d).

(a) The structure is caused to turn into a bainite structure having an area ratio of 95% or more, and is caused to turn into a microstructure in which a bainite lath width is 5 μm or less, and then by an aging treatment, fine V carbide is caused to disperse in the bainite structure, and thereby an endurance ratio higher than that of a conventional non-heat-treated steel can be obtained. By the aging treatment, fine V carbide precipitates, and thereby tensile strength and fatigue strength both increase. However, when the temperature of the aging treatment becomes higher than a certain temperature, V carbide is coarsened and the tensile strength stops increasing, but the fatigue strength further increases. As a result, when the temperature of the aging treatment becomes higher than a certain temperature, the endurance ratio improves.

(b) As long as the structure is the bainite structure having an area ratio of 95% or more, and is the microstructure in which the bainite lath width is 5 μm or less, it is possible to obtain the high toughness and high endurance ratio in which U-notch Charpy absorbed energy at 20° C. is 80 J/cm$^2$ or more and the endurance ratio is 0.60 or more. In a conventional non-heat-treated steel (with its endurance ratio of 0.48 or so), improving the endurance ratio to be 0.60 or more means to, in the case of the tensile strength being 1100 MPa, for example, improve the fatigue strength by about 130 MPa or more without increasing the tensile strength. Machinability strongly relies on the tensile strength. As long as it is possible to improve only the fatigue strength without increasing the tensile strength, the fatigue strength is improved without deteriorating the machinability and both the excellent machinability and the high fatigue strength are accomplished.

(c) A steel product to which low C, high N and V are added is hot forged and molded, and then an average cooling rate down to 300° C. is set to fall within a range of not less than 3° C./second nor more than 120° C./second, and thereby a desired fine bainite structure can be obtained even with the ordinary hot forging.

(d) When Ti is contained in the steel, Ti turns into nitride at high temperature preferentially to carbide, and thereby coarse Ti nitride is formed, and Ti nitride does not contribute to precipitation strengthening and further significantly decreases an impact value. In contrast to this, as for V, its dissolution amount at the time when the steel is austenitized is large, and even though part of V turns into nitride, the amount of nitride is small, by the aging treatment, most of dissolved V turns into V carbide to precipitate, and a large amount of precipitation strengthening can be obtained.

The present invention was completed for the first time by further repeated examinations based on these pieces of knowledge.

Hereinafter, the present invention will be explained in detail. First, there will be explained reasons for limiting the above-described steel component range of the steel part for machine structural use. Here, "%" of the component means mass %.

C: 0.05 to 0.20%

C is an important element that determines the strength of the steel. For sufficiently obtaining the strength as the part, the lower limit is set to 0.05%. The alloy cost is low as compared with other alloy elements, and as long as it is possible to add C in large amounts, the alloy cost of the steel product can be reduced. However, when a large amount of C is added, at the time of bainite transformation, retained austenite and martensite island in which C is concentrated are formed at boundaries of laths, and the toughness and the endurance ratio decrease, and thus the upper limit is set to 0.20%.

Si: 0.10 to 1.00%

Si is an effective element as an element that increases the strength of the steel and as a deoxidizing element. For obtaining these effects, the lower limit is set to 0.10%. Further, Si is an element that promotes ferrite transformation, and when the upper limit exceeds 1.00%, ferrite is formed at grain boundaries of prior austenite and the fatigue strength and the endurance ratio significantly decrease, and thus the upper limit is set to 1.00%.

Mn: 0.75 to 3.00%

Mn is an element that promotes the bainite transformation, and is an important element for turning the structure into bainite in a cooling process after hot forging. Further, Mn has an effect of improving the machinability by bonding to S to form sulfides, and also has an effect of maintaining the high toughness by suppressing the growth of austenite grains. For exhibiting these effects, the lower limit is set to 0.75%. On the other hand, when Mn in an amount in excess of 3.00% is added, the hardness of a base metal increases to make the steel brittle, and thus the toughness decreases and the machinability deteriorates significantly. The upper limit is set to 3.00%.

P: 0.001 to 0.050%

As for P, 0.001% or more is ordinarily contained in the steel as an inevitable impurity, and thus the lower limit is set to 0.001%. Then, P that is contained is segregated at grain boundaries of prior austenite and the like to significantly decrease the toughness, and thus the upper limit is limited to 0.050%. It is preferably 0.030% or less, and is more preferably 0.010% or less.

S: 0.001 to 0.200%

S has an effect of improving the machinability by forming sulfides with Mn, and also has an effect of maintaining the high toughness by suppressing the growth of austenite grains. For exhibiting these effects, the lower limit is set to 0.001%. However, although S depends also on the amount of Mn, when S is added in large amounts, anisotropy in mechanical properties such as the toughness is increased, and thus the upper limit is set to 0.200%.

V: exceeding 0.25 to 0.50%

V is an element effective for increasing the strength and the endurance ratio by forming carbide to strengthen the bainite structure by precipitation. For sufficiently obtaining the above effect, the content of 0.05% or more is required. On the other hand, when the content exceeds 0.50%, the effect is saturated and the alloy cost is increased, and further hot ductility significantly decreases to thus cause a problem of occurrence of flaws at the time of hot rolling of the bar steel and hot forging of the part. In the present invention, for accomplishing the improvement of the strength and the endurance ratio, in particular, the range of V is set to exceeding 0.25 to 0.50%.

Cr: 0.01 to 1.00%

Cr is an element effective for promoting the bainite transformation. For obtaining the effect, 0.01% or more of Cr is added, but even though Cr is added in excess of 1.00%, the effect is saturated and the alloy cost is only increased. Thus, the content of Cr is set to 0.01 to 1.00%.

Al: 0.001 to 0.500%

Al is effective for maintaining the high toughness by suppressing deoxidation and the growth of austenite grains. Further, Al has an effect of preventing tool abrasion by bonding to oxygen at the time of machining to be attached to a tool surface. For exhibiting these effects, the lower limit is set to 0.001%. On the other hand, when the upper limit exceeds 0.500%, a large number of hard inclusions are formed, and the toughness, the endurance ratio, and the machinability all decrease/deteriorate. Thus, the upper limit is set to 0.500%.

N: 0.0080 to 0.0200%

N is an element that forms nitrides with various alloy elements such as V and Al, maintains the high toughness even though the strength is increased by suppressing the growth of austenite grains and making the bainite structure fine, and is further important for obtaining the high endurance ratio. For obtaining the above effect, the lower limit is set to 0.0080%. On the other hand, when the upper limit exceeds 0.0200%, the effect is saturated. Further, the hot ductility significantly decreases to thus cause a problem of occurrence of flaws at the time of hot rolling of the bar steel and hot forging of the part, and thus the upper limit is set to 0.0200%.

Ca: 0.0003 to 0.0100%, Mg: 0.0003 to 0.0100%, and Zr: 0.0005 to 0.1000%

In the present invention, Ca, Mg, and Zr are not mandatory. One type or two types or more of Ca: 0.0003 to 0.0100%, Mg: 0.0003 to 0.0100%, and Zr: 0.0005 to 0.1000% may also be contained.

Ca, Mg, and Zr each have an effect of forming oxides to be crystallization nuclei of Mn sulfides and uniformly and finely dispersing Mn sulfides. Further, each of the elements has an effect of being solid-dissolved in Mn sulfides to decrease the deformability of Mn sulfides and suppressing the extension of the shape of Mn sulfides after rolling and hot forging to decrease the anisotropy in the mechanical properties such as the toughness. For exhibiting these effects, the lower limit of each of Ca and Mg is set to 0.0003% and the lower limit of Zr is set to 0.0005%. On the other hand, when Ca and Mg each exceed 0.0100% and Zr exceeds 0.1000%, a large number of hard inclusions such as these oxides and sulfides are formed thereby, and the toughness and the endurance ratio decrease, and the machinability deteriorates. Thus, the upper limit of each of Ca and Mg is set to 0.0100% and the upper limit of Zr is set to 0.1000%.

Mo: 0.01 to 1.00% and Nb: 0.001 to 0.200%

In the present invention, Mo and Nb are not mandatory. One type or two types of Mo: 0.01 to 1.00% and Nb: 0.001 to 0.200% may also be contained.

Mo and Nb each are an element effective for increasing the strength and the endurance ratio by forming carbide to strengthen the bainite structure by precipitation, similarly to V. For obtaining the above effect, the lower limit of Mo is set to 0.01% and the lower limit of Nb is set to 0.001%. Even though Mo and Nb are each added more than necessary, the effect is saturated and the increase in alloy cost is only caused. Thus, the upper limit of Mo is set to 1.00% and the upper limit of Nb is set to 0.200%.

Next, there will be explained reasons for limiting the steel structure of the steel part for machine structural use of the present invention.

The bainite structure having an area ratio of 95% or more

The reason why the structure is defined to be the bainite structure having an area ratio of 95% or more is because if the main structure is the bainite structure, the steel has the high toughness and high endurance ratio, but in the case when, in an area ratio, 5% or more of ferrite, retained austenite, and martensite island, which are the remaining structures of the steel, exists, the toughness and the endurance ratio significantly decrease. As these remaining structures are smaller and smaller, the toughness and the endurance ratio are higher, and the bainite structure is preferably 97% or more in an area ratio.

The bainite lath width being 5 μm or less

Further, the reason why the bainite lath width is defined to be 5 μm or less is because if the width exceeds 5 μm, the structure is the bainite structure that is transformed at relatively high temperature, coarse cementite precipitates at lath boundaries, and the toughness and the endurance ratio are low. As the lath width is narrower, the structure is the bainite structure that is transformed at low temperature, the size of cementite also becomes smaller, and the steel has the higher toughness and higher endurance ratio. Thus, the bainite lath width is preferably set to 3 μm or less.

V carbide having an average grain diameter of not less than 4 nm nor more than 7 nm dispersedly existing in the bainite structure The reason why the average grain diameter of V carbide in the bainite structure is defined to be 4 nm or more is because if the average grain diameter is less than 4 nm, the steel has the high fatigue strength, but at the same time, the tensile strength is also high and the value of the endurance ratio is decreased, thus making it impossible to accomplish both the high fatigue strength and the excellent machinability. Further, the reason why the upper limit value of the average grain diameter of V carbide is defined to be 7 nm is because if the average grain diameter exceeds 7 nm, not only the tensile strength but also the fatigue strength significantly decreases, thus making it impossible to accomplish the high fatigue strength.

The area ratio of V carbide in the bainite structure being 0.18% or more

Further, the reason why the area ratio of V carbide in the bainite structure is defined to be 0.18% or more is because if the area ratio is less than 0.18%, the amount of precipitation strengthening is small and the endurance ratio is low.

Incidentally, in the case of Mo and Nb being contained, in addition to V carbide, Mo carbide and Nb carbide each having an average grain diameter of not less than 4 nm nor more than 7 nm also dispersedly exist in the bainite structure. In the case, in the bainite structure, the total area ratio of V carbide, Mo carbide, and Nb carbide is 0.18% or more.

Next, there will be explained a manufacturing method of the steel part for machine structural use of the present invention.

First, the steel product (bar steel, steel plate, or the like) containing the above-described chemical composition and the balance being composed of Fe and inevitable impurities is heated to not lower than 1100° C. nor higher than 1300° C. to be hot forged. The reason why it is defined that the steel product made of the above-described chemical composition is heated to not lower than 1100° C. nor higher than 1300° C. is to sufficiently dissolve V, Mo, and Nb in the steel by the heating prior to the hot forging. Here, V, Mo, and Nb that are dissolved turn into carbides of V, Mo, and Nb in a subsequent aging treatment to dispersedly precipitate in the bainite structure. When the heating temperature is lower than 1100° C., it is not possible to sufficiently dissolve V, Mo, and Nb in the steel, and the amount of precipitation strengthening in the subsequent aging treatment is small and thus the fatigue strength and the endurance ratio decrease. On the other hand, when the heating temperature is increased more than necessary in excess of 1300° C., the growth of austenite grains is promoted and the structure that is transformed in a subsequent cooling process is coarsened, and thus the toughness and the endurance ratio decrease. Thus, the heating temperature of the steel product is set to be not lower than 1100° C. nor higher than 1300° C.

After being hot forged, the hot-forged steel product is cooled at an average cooling rate down to 300° C. set to be not less than 3° C./second nor more than 120° C./second. The reason why the average cooling rate down to 300° C. is defined to be not less than 3° C./second nor more than 120° C./second is to turn the structure into the bainite structure having an area ratio of 95% or more and to set the bainite lath width to be 5 μm or less. In a temperature range of lower than 300° C., the bainite ratio and the bainite lath width that are defined in the present invention do not change by the cooling rate, so that the cooling rate from the temperature after the hot forging down to 300° C. is limited. When the average cooling rate is less than 3° C./second, ferrite having an area ratio of 5% or more is formed along grain boundaries of prior austenite, and further the bainite lath width exceeds 5 μm to thus significantly decrease the toughness, the fatigue strength, and the endurance ratio. On the other hand, when the average cooling rate exceeds 120° C./second, retained austenite and martensite island having an area ratio of 5% or more are formed at boundaries of bainite laths to thus significantly decrease the toughness and the endurance ratio (fatigue strength/tensile strength).

After the cooling, the aging treatment is performed in a temperature range of not lower than 550° C. nor higher than 700° C. The reason why it is defined that the aging treatment is performed at not lower than 550° C. nor higher than 700° C. is because fine V carbide, Mo carbide, and Nb carbide are caused to precipitate in the bainite structure by this aging treatment to strengthen the bainite structure by precipitation to thereby obtain the high fatigue strength and high endurance ratio. When the aging treatment temperature is lower than 550° C., the precipitation amount of V carbide, Mo carbide, and Nb carbide is small and the sufficient amount of precipitation strengthening cannot be obtained and thus the fatigue strength and the endurance ratio are both low, or V carbide, Mo carbide, and Nb carbide sufficiently precipitate and the steel has the high fatigue strength but at the same time, the tensile strength is also high and thus the endurance ratio is low. The lower limit of the heat treatment temperature is set to 550° C. On the other hand, when the treatment temperature exceeds 700° C., V carbide, Mo carbide, and Nb carbide are coarsened, thereby making it impossible to obtain the sufficient amount of precipitation strengthening, the tensile strength and the fatigue strength are both low, and thus the high fatigue strength cannot be accomplished. Thus, the upper limit is set to 700° C. Within the above-described defined temperature range, as the aging treatment temperature is higher, the endurance ratio is improved, and thus the aging treatment temperature is preferably 600° C. or higher and is more preferably set to 650° C. or higher.

Incidentally, the present invention makes it possible to obtain the steel part for machine structural use having the high fatigue strength and high toughness, but for sufficiently securing the machinability, the tensile strength is desirably set to 1200 MPa or less.

EXAMPLE

The present invention will be explained according to examples. Incidentally, these examples are to explain the technical reasons and effects of the present invention and are not intended to limit the scope of the present invention.

Steels each having a chemical composition shown in Table 1 and being 100 kg were melted in a vacuum melting furnace. Each of the steels was rolled to a bar steel having a diameter of 55 mm, and then a test piece for forging was cut out of each of the bar steels and was heated to a heating temperature shown in Table 1 to be hot forged. After the hot forging, as a cooling method down to 300° C., oil cooling, water cooling, or air cooling was performed, the cooling rate was controlled, and then, at lower than 300° C., air cooling was performed. The average cooling rate was obtained by dividing the value obtained by subtracting 300° C. from the temperature of the test piece after being hot forged by the time required for cooling the test piece down to 300° C. after the hot forging. Thereafter, at each of aging temperatures shown in Table 1, the aging treatment was performed. Incidentally, each underline part in Table 1 is a condition outside the range of the present invention.

From each of middle portions of these forged products, a No. 14 tensile test piece of JIS Z 2201, a No. 1 rotating bending fatigue test piece of JIS Z 2274, and a 2 mm U-notched impact test piece of JIS Z 2202 were obtained, and the tensile strength, the Charpy absorbed energy at 20° C., and the fatigue strength were obtained. Here, the fatigue strength was defined to be the stress amplitude when at a rotating bending fatigue test, the test piece was endured without being fractured by $10^7$ rotations. Further, the ratio of the obtained fatigue strength to the obtained tensile strength was obtained as the endurance ratio (the fatigue strength/the tensile strength).

From a ¼ thickness portion, of each of the forged products, in the L direction, a test piece for structure observation was obtained. The area ratio of bainite was calculated in a manner that the test piece was polished to have a mirror finished surface and then was subjected to repeller etching, and the structures of ferrite, martensite island, and the like, being the remaining portion other than bainite, were confirmed, an optical photomicrograph of 500 magnifications was taken at 10 visual fields of each of the test pieces, and then was image-analyzed. Further, as for the bainite lath width, the test piece was polished again to have a mirror finished surface and then was subjected to nital etching, and a scanning electron photomicrograph of 5000 magnifications was taken at 10 visual fields of each of the test pieces, the lath widths in 10 places of each of the visual fields were measured, and the average value of the lath widths was obtained. As for the average grain diameter of carbide, the test piece was finished into a thin film by electropolishing, and then by a transmission electron microscope, a transmission electron photomicrograph of 15000 magnifications was taken at 10 visual fields of each of the test pieces, an area of each of alloy carbides of V, Mo, and Nb observed in the photomicrographs was obtained by image analysis, a circle-equivalent diameter of each of the areas was calculated, and the average value of the circle-equivalent diameters was obtained. Further, the area ratio of the precipitates was calculated from the total area of alloy carbides occupied in the observation area. Incidentally, the identification of carbide was performed by analysis of a selected area electron diffraction pattern by using a transmission electron microscope, or by elemental analysis by energy dispersive X-ray spectroscopy.

In each of present invention examples of No. 1 to 23, the structure is the bainite structure having an area ratio of 95% or more and is the microstructure in which the lath width is 5 μm or less, and the aging treatment temperature is 550° C. or higher, so that the steel causes V carbide having an average grain diameter of not less than 4.2 nm nor more than 6.9 nm to sufficiently precipitate therein and has the high toughness and high endurance ratio in which the Charpy absorbed energy at 20° C. is 90 J/cm$^2$ or more and the endurance ratio is 0.61 or more. The tensile strength is 1200 MPa or less in order to secure the machinability, but as is clear from the comparison with the equivalent tensile strength, the higher strength is achieved rather than a ferrite-pearlite non-heat-treated steel in a conventional example of No. 35.

In contrast to this, in comparative examples of No. 24 and 25, the content of C or Si is large, and further No. 33 and 34 each fall within the defined steel composition range, but the average cooling rate is outside the definition and a large amount of the remaining portion of ferrite, retained austenite, and the like exists at boundaries of bainite laths, and further in No. 34, the bainite lath width is large, and the Charpy absorbed energy and the endurance ratio are low. In No. 26, the steel composition and the heat treatment condition are each outside the definition, and thus the sufficient precipitation strengthening cannot be obtained and the endurance ratio is low. In No. 26, 27 and 30, the alloy elements are added more than necessary, and thus the Charpy absorbed energy is low. In No. 28 and 29, Ti is contained and the Charpy absorbed energy is low, and further in No. 29, the sufficient precipitation strengthening cannot be obtained and the endurance ratio is low. In No. 31, the steel causes fine carbide to precipitate therein in large amounts and has the high fatigue strength but the tensile strength is also high, and thus the endurance ratio and the Charpy absorbed energy are both low. In No. 32, the aging treatment temperature is higher than the defined aging treatment temperature and the average grain diameter of carbide is in excess of 7 nm, which is coarse, and thus the strength and the endurance ratio are low.

As is clear from the above, the present invention examples in which the conditions defined in the present invention are all satisfied are each more excellent in toughness and fatigue property than the comparative examples and conventional example.

TABLE 1

| TEST No. | CLASSIFICATION | C | Si | Mn | P | S | V | Cr | Al | N | Ca | Mg | Zr | Mo | Nb | Ti | HEATING TEMPERATURE (° C.) |
|---|---|---|---|---|---|---|---|---|---|---|---|---|---|---|---|---|---|
| 1 | PRESENT INVENTION | 0.05 | 0.38 | 2.23 | 0.006 | 0.030 | 0.32 | 0.31 | 0.050 | 0.0152 | | | | | | | 1250 |
| 2 | PRESENT INVENTION | 0.18 | 0.40 | 2.34 | 0.005 | 0.043 | 0.32 | 0.30 | 0.044 | 0.0147 | | | | | | | 1250 |

TABLE 1-continued

| | | | | | | | | | | | | | | | | |
|---|---|---|---|---|---|---|---|---|---|---|---|---|---|---|---|---|
| 3 | PRESENT INVEN-TION | 0.15 | 0.40 | 2.24 | 0.005 | 0.037 | 0.32 | 0.32 | 0.040 | 0.0082 | | | | | | 1100 |
| 4 | PRESENT INVEN-TION | 0.13 | 0.36 | 2.32 | 0.005 | 0.037 | 0.33 | 0.33 | 0.039 | 0.0176 | | | | | | 1300 |
| 5 | PRESENT INVEN-TION | 0.14 | 0.39 | 2.30 | 0.006 | 0.035 | 0.48 | 0.31 | 0.038 | 0.0168 | | | | | | 1250 |
| 6 | PRESENT INVEN-TION | 0.13 | 0.36 | 2.49 | 0.004 | 0.036 | 0.27 | 0.33 | 0.053 | 0.0159 | | | | | | 1250 |
| 7 | PRESENT INVEN-TION | 0.13 | 0.35 | 0.78 | 0.005 | 0.042 | 0.33 | 0.34 | 0.058 | 0.0146 | | | | | | 1250 |
| 8 | PRESENT INVEN-TION | 0.09 | 0.36 | 2.92 | 0.004 | 0.197 | 0.33 | 0.35 | 0.044 | 0.0163 | | | | | | 1250 |
| 9 | PRESENT INVEN-TION | 0.12 | 0.36 | 2.43 | 0.007 | 0.032 | 0.32 | 0.01 | 0.035 | 0.0163 | | | | | | 1250 |
| 10 | PRESENT INVEN-TION | 0.10 | 0.39 | 2.27 | 0.006 | 0.036 | 0.27 | 0.94 | 0.048 | 0.0148 | | | | | | 1250 |
| 11 | PRESENT INVEN-TION | 0.15 | 0.94 | 2.30 | 0.004 | 0.040 | 0.33 | 0.32 | 0.057 | 0.0175 | | | | | | 1250 |
| 12 | PRESENT INVEN-TION | 0.12 | 0.36 | 2.45 | 0.007 | 0.040 | 0.32 | 0.34 | 0.497 | 0.0174 | | | | | | 1250 |
| 13 | PRESENT INVEN-TION | 0.14 | 0.37 | 2.39 | 0.008 | 0.045 | 0.33 | 0.33 | 0.046 | 0.0164 | | | | | | 1250 |
| 14 | PRESENT INVEN-TION | 0.13 | 0.35 | 2.40 | 0.005 | 0.037 | 0.33 | 0.34 | 0.052 | 0.0160 | | | | | | 1250 |
| 15 | PRESENT INVEN-TION | 0.14 | 0.37 | 2.27 | 0.004 | 0.043 | 0.33 | 0.32 | 0.044 | 0.0147 | 0.0039 | 0.0010 | 0.0014 | | | 1250 |
| 16 | PRESENT INVEN-TION | 0.14 | 0.35 | 2.34 | 0.007 | 0.040 | 0.33 | 0.33 | 0.036 | 0.0170 | 0.0028 | 0.0015 | | | | 1250 |
| 17 | PRESENT INVEN-TION | 0.15 | 0.37 | 2.27 | 0.003 | 0.039 | 0.33 | 0.31 | 0.047 | 0.0149 | | 0.0029 | 0.0054 | | | 1250 |
| 18 | PRESENT INVEN-TION | 0.14 | 0.40 | 2.49 | 0.007 | 0.039 | 0.33 | 0.34 | 0.048 | 0.0147 | | | 0.0028 | | | 1250 |
| 19 | PRESENT INVEN-TION | 0.12 | 0.39 | 2.37 | 0.005 | 0.033 | 0.26 | 0.34 | 0.048 | 0.0154 | | | | 0.84 | 0.06 | 1250 |
| 20 | PRESENT INVEN-TION | 0.15 | 0.38 | 2.34 | 0.007 | 0.036 | 0.26 | 0.31 | 0.040 | 0.0150 | | | | 0.15 | | 1250 |
| 21 | PRESENT INVEN-TION | 0.13 | 0.36 | 2.30 | 0.005 | 0.044 | 0.27 | 0.31 | 0.051 | 0.0147 | | | | 0.18 | | 1250 |
| 22 | PRESENT INVEN-TION | 0.14 | 0.33 | 2.25 | 0.006 | 0.045 | 0.26 | 0.34 | 0.041 | 0.0143 | 0.0028 | | 0.0018 | 0.18 | | 1250 |
| 23 | PRESENT INVEN-TION | 0.12 | 0.36 | 2.31 | 0.005 | 0.039 | 0.27 | 0.33 | 0.025 | 0.0128 | | 0.0025 | | 0.11 | 0.03 | 1250 |
| 24 | COMPAR-ATIVE EXAMPLE | 0.30 | 0.21 | 2.05 | 0.005 | 0.040 | 0.28 | 0.26 | 0.054 | 0.0150 | | | | | | 1250 |
| 25 | COMPAR-ATIVE EXAMPLE | 0.12 | 1.24 | 2.29 | 0.005 | 0.038 | 0.26 | 0.33 | 0.040 | 0.0159 | | | | 0.26 | 0.10 | 1250 |
| 26 | COMPAR-ATIVE EXAMPLE | 0.13 | 0.40 | 3.14 | 0.005 | 0.243 | 0.32 | 0.31 | 0.033 | 0.0164 | | | | | | 1050 |
| 27 | COMPAR-ATIVE EXAMPLE | 0.13 | 0.38 | 2.44 | 0.080 | 0.045 | 0.33 | 0.34 | 0.051 | 0.0158 | 0.0025 | | 0.0025 | | | 1250 |
| 28 | COMPAR-ATIVE EXAMPLE | 0.14 | 0.33 | 2.35 | 0.006 | 0.037 | 0.32 | 0.31 | 0.036 | 0.0127 | | | | | 0.04 | 1250 |

TABLE 1-continued

| | | | | | | | | | | | | | | | | |
|---|---|---|---|---|---|---|---|---|---|---|---|---|---|---|---|---|
| 29 | COMPARATIVE EXAMPLE | 0.12 | 0.37 | 2.30 | 0.004 | 0.031 | 0.03 | 0.35 | 0.025 | 0.0148 | | | | | 0.03 | 1250 |
| 30 | COMPARATIVE EXAMPLE | 0.12 | 0.38 | 2.42 | 0.005 | 0.033 | 0.33 | 0.30 | 0.597 | 0.0154 | | | | | | 1320 |
| 31 | COMPARATIVE EXAMPLE | 0.14 | 0.37 | 2.48 | 0.004 | 0.038 | 0.32 | 0.33 | 0.031 | 0.0074 | 0.0037 | 0.0020 | 0.0064 | | | 1250 |
| 32 | COMPARATIVE EXAMPLE | 0.12 | 0.95 | 2.27 | 0.003 | 0.042 | 0.26 | 0.34 | 0.039 | 0.0169 | | | | 0.41 | | 1250 |
| 33 | COMPARATIVE EXAMPLE | 0.13 | 0.39 | 2.31 | 0.005 | 0.042 | 0.32 | 0.31 | 0.050 | 0.0164 | | | | | | 1250 |
| 34 | COMPARATIVE EXAMPLE | 0.15 | 0.36 | 2.43 | 0.004 | 0.039 | 0.33 | 0.35 | 0.056 | 0.0152 | | | | | | 1250 |
| 35 | CONVENTIONAL EXAMPLE | 0.28 | 0.54 | 1.91 | 0.010 | 0.054 | 0.30 | 1.06 | 0.031 | 0.0167 | | | | | | 1250 |

| TEST No. | AVERAGE COOLING RATE (° C./s) | AGING TEMPERATURE (° C.) | BAINITE AREA RATIO (%) | BAINITE LATH WIDTH (μm) | CARBIDE AVERAGE GRAIN DIAMETER (μm) | CARBIDE AREA RATIO (%) | CHARPY ABSORBED ENERGY (J/cm$^2$) | TENSILE STRENGTH (MPa) | FATIGUE STRENGTH (MPa) | ENDURANCE RATIO |
|---|---|---|---|---|---|---|---|---|---|---|
| 1 | 33 | 650 | 97 | 3.0 | 6.2 | 0.35 | 179 | 966 | 619 | 0.64 |
| 2 | 26 | 650 | 98 | 2.8 | 6.0 | 0.34 | 105 | 1126 | 716 | 0.64 |
| 3 | 27 | 650 | 98 | 3.2 | 5.6 | 0.34 | 125 | 1041 | 676 | 0.65 |
| 4 | 28 | 650 | 97 | 2.6 | 5.4 | 0.37 | 100 | 1117 | 721 | 0.65 |
| 5 | 45 | 650 | 96 | 2.7 | 6.2 | 0.36 | 137 | 1143 | 694 | 0.61 |
| 6 | 25 | 650 | 98 | 2.5 | 6.1 | 0.35 | 154 | 1110 | 702 | 0.63 |
| 7 | 45 | 625 | 97 | 2.5 | 5.5 | 0.36 | 221 | 832 | 516 | 0.62 |
| 8 | 43 | 650 | 96 | 2.3 | 5.7 | 0.36 | 90 | 1178 | 740 | 0.63 |
| 9 | 44 | 650 | 96 | 1.9 | 5.3 | 0.37 | 128 | 1045 | 672 | 0.64 |
| 10 | 30 | 650 | 97 | 2.8 | 5.4 | 0.36 | 140 | 1145 | 728 | 0.64 |
| 11 | 43 | 650 | 96 | 1.9 | 5.7 | 0.35 | 102 | 1176 | 741 | 0.63 |
| 12 | 27 | 650 | 98 | 2.8 | 6.4 | 0.36 | 108 | 1118 | 719 | 0.64 |
| 13 | 4 | 650 | 100 | 4.6 | 5.9 | 0.36 | 123 | 1129 | 710 | 0.63 |
| 14 | 109 | 650 | 95 | 1.9 | 5.6 | 0.36 | 141 | 1110 | 700 | 0.63 |
| 15 | 42 | 550 | 97 | 2.7 | 4.2 | 0.19 | 124 | 1137 | 703 | 0.62 |
| 16 | 26 | 680 | 97 | 3.1 | 6.4 | 0.35 | 152 | 1072 | 693 | 0.65 |
| 17 | 41 | 650 | 97 | 2.0 | 6.3 | 0.34 | 144 | 1075 | 703 | 0.65 |
| 18 | 39 | 650 | 97 | 2.1 | 5.9 | 0.34 | 106 | 1134 | 721 | 0.64 |
| 19 | 30 | 700 | 97 | 2.9 | 6.9 | 0.37 | 131 | 1195 | 799 | 0.67 |
| 20 | 41 | 650 | 97 | 2.3 | 6.4 | 0.35 | 129 | 1147 | 749 | 0.65 |
| 21 | 26 | 650 | 97 | 2.3 | 6.1 | 0.35 | 90 | 1153 | 725 | 0.63 |
| 22 | 36 | 650 | 97 | 2.4 | 6.6 | 0.36 | 98 | 1142 | 715 | 0.63 |
| 23 | 28 | 650 | 97 | 2.1 | 6.3 | 0.32 | 106 | 1106 | 700 | 0.63 |
| 24 | 35 | 650 | 92 | 2.0 | 5.9 | 0.34 | 26 | 1181 | 670 | 0.57 |
| 25 | 37 | 650 | 91 | 2.7 | 6.3 | 0.35 | 119 | 1123 | 647 | 0.58 |
| 26 | 37 | 650 | 97 | 2.5 | 6.0 | 0.11 | 41 | 1132 | 627 | 0.55 |
| 27 | 27 | 650 | 99 | 2.3 | 5.5 | 0.36 | 9 | 1110 | 657 | 0.59 |
| 28 | 35 | 650 | 97 | 2.7 | 6.3 | 0.33 | 31 | 1111 | 690 | 0.62 |
| 29 | 41 | 650 | 97 | 3.4 | 8.3 | 0.15 | 67 | 992 | 545 | 0.55 |
| 30 | 28 | 650 | 97 | 2.5 | 6.1 | 0.42 | 49 | 1089 | 659 | 0.61 |
| 31 | 35 | 530 | 97 | 2.5 | 2.3 | 0.34 | 41 | 1224 | 673 | 0.55 |
| 32 | 38 | 720 | 97 | 2.4 | 7.9 | 0.51 | 245 | 758 | 449 | 0.59 |
| 33 | 194 | 650 | 93 | 1.1 | 6.4 | 0.36 | 63 | 1135 | 657 | 0.58 |
| 34 | 1.5 | 650 | 90 | 5.4 | 5.9 | 0.34 | 50 | 1115 | 638 | 0.57 |
| 35 | 0.3 | — | FERRITE-PEARLITE STRUCTURE | | 2.1 | 0.12 | 28 | 1109 | 532 | 0.48 |

※EACH UNDERLINE PART IS A CONDITION OUTSIDE THE RANGE OF THE PRESENT INVENTION

What is claimed is:

1. A steel part for machine structural use made of a steel consisting of, in mass %, C: 0.05 to 0.20%, Si: 0.10 to 1.00%, Mn: 0.75 to 3.00%, P: 0.001 to 0.050%, S: 0.001 to 0.200%, V: exceeding 0.25 to 0.50%, Cr: 0.01 to 0.35%, Al: 0.001 to 0.500%, and N: 0.0080 to 0.0200%, and optionally Ca: 0.0003 to 0.0100%, optionally Mg: 0.0003 to 0.0100%, optionally Zr: 0.0005 to 0.1000%, optionally Mo: 0.01 to 1.00%, and optionally Nb: 0.001 to 0.200% a balance being composed of Fe and inevitable impurities, wherein a steel structure contains a bainite structure having an area ratio of 95% or more, a bainite lath width is 5 μm or less, V carbide having an average grain diameter of not less than 4 nm nor more than 7 nm dispersedly exists in the bainite structure, and an area ratio of V carbide in the bainite structure is 0.18% or more.

2. The steel part for machine structural use according to claim 1, wherein Charpy absorbed energy at 20° C. is 80 J/cm$^2$ or more and an endurance ratio is 0.60 or more.

3. A manufacturing method of a steel part for machine structural use, comprising:

heating a steel product consisting of, in mass %,

C: 0.05 to 0.20%,

Si: 0.10 to 1.00%,

Mn: 0.75 to 3.00%,

P: 0.001 to 0.050%,

S: 0.001 to 0.200%,

V: exceeding 0.25 to 0.50%,

Cr: 0.01 to 0.35%,

Al: 0.001 to 0.500%, and

N: 0.0080 to 0.0200%, and optionally Ca: 0.0003 to 0.0100%, optionally Mg: 0.0003 to 0.0100%, optionally Zr: 0.0005 to 0.1000%, optionally Mo: 0.01 to 1.00%, and optionally Nb: 0.001 to 0.200% a balance being composed of Fe and inevitable impurities to not lower than 1100° C. nor higher than 1300° C. and hot forging the steel product;

after said hot forging, cooling the hot-forged steel product at an average cooling rate down to 300° C. set to be not less than 3° C./second nor more than 120° C./second; and after said cooling, performing an aging treatment within a temperature range of not lower than 550° C. nor higher than 700° C.

* * * * *